United States Patent [19]

Hara

[11] Patent Number: 4,942,871

[45] Date of Patent: Jul. 24, 1990

[54] FLOATABLE BUBBLE BATH ASSEMBLY

[75] Inventor: Zenzaburo Hara, Tokyo, Japan

[73] Assignee: Hara Health Industrial Co., Ltd., Japan

[21] Appl. No.: 456,039

[22] Filed: Dec. 22, 1989

Related U.S. Application Data

[63] Continuation of Ser. No. 249,862, Sep. 27, 1988, abandoned.

[30] Foreign Application Priority Data

Sep. 29, 1987 [JP] Japan ..... 62-246936

[51] Int. Cl.[5] ..... A61H 9/00

[52] U.S. Cl. ..... 128/66; 4/492

[58] Field of Search ..... 128/24 R, 24.2, 33, 128/37–40, 47, 50, 53, 64–66, 400, 402; 15/1.7; 4/490, 492, 496; 134/167 R; 239/289, 332; 446/154, 163, 164, 211

[56] References Cited

U.S. PATENT DOCUMENTS

| | | | |
|---|---|---|---|
| 2,730,095 | 1/1956 | Scott | 128/66 |
| 3,286,712 | 11/1966 | Roden | 4/544 |
| 3,366,110 | 1/1968 | Gaylord | 4/541 |
| 3,580,247 | 5/1971 | Schneider | 128/66 |
| 3,585,991 | 6/1971 | Balamuth | 128/66 |
| 3,587,976 | 6/1971 | Jacuzzi | 178/56 |
| 3,641,996 | 2/1972 | Friend | 128/66 |
| 3,674,020 | 7/1972 | Jacuzzi et al. | 128/66 |
| 3,758,276 | 9/1973 | Bond et al. | 15/1.7 |
| 3,806,964 | 4/1974 | Vanegas et al. | 4/542 |
| 3,842,823 | 10/1974 | Jacuzzi et al. | 128/66 |
| 3,874,374 | 4/1975 | Jacuzzi | 128/66 |
| 3,961,382 | 6/1976 | Peterson | 128/66 |
| 3,977,027 | 8/1976 | Speck | 128/66 |
| 4,100,917 | 7/1978 | Talge et al. | 128/66 |
| 4,105,557 | 8/1978 | Weatherholt | 15/1.7 |
| 4,127,117 | 11/1978 | Peterson | 128/66 |
| 4,217,892 | 8/1980 | Brill | 128/66 |
| 4,225,984 | 10/1980 | Lindsay | 178/66 |
| 4,458,676 | 7/1984 | Pileggi | 178/66 |
| 4,465,522 | 8/1984 | Taldo | 179/66 |
| 4,599,753 | 7/1986 | Goodman | 4/542 |
| 4,602,391 | 7/1986 | Shephard | 128/66 |
| 4,665,572 | 5/1987 | Davidson | 4/542 |
| 4,726,917 | 2/1988 | Abe | 128/66 |
| 4,774,934 | 10/1988 | Hara | 128/66 |
| 4,776,046 | 11/1988 | Newberry | 128/66 |
| 4,784,171 | 11/1988 | Campbell | 134/167 R |

FOREIGN PATENT DOCUMENTS

| | | | |
|---|---|---|---|
| 0210821 | 2/1987 | European Pat. Off. | 4/541 |
| 2428581 | 1/1976 | Fed. Rep. of Germany | 128/66 |
| 561059 | 4/1975 | Switzerland | 129/66 |
| 2203333 | 10/1988 | United Kingdom . | |

*Primary Examiner*—Michael H. Thaler
*Assistant Examiner*—William Lewis
*Attorney, Agent, or Firm*—Kane, Dalsimer, Sullivan, Kurucz, Levy, Eisele and Richard

[57] ABSTRACT

There is disclosed a bubble bath assembly including a housing, a pump mechanism and a water-jetting mechanism. The housing has an inlet and an outlet. The pump means is encased within the housing in order to draw water into the housing through the inlet and to discharge water under pressure from the outlet. The water-jetting mechanism is communicatively connected to the outlet of the housing to discharge water in a jet therefrom. This assembly is characterized in that the housing includes a float for floating the bubble bath assembly on bath water in such a manner that the water-jetting mechanism is held over the bath water and the inlet of the housing is held under the bath water. The assembly is also characterized in that the water-jetting mechanism has an outlet port which directly confronts the bath water when the assembly floats on the bath water, so that water to be discharged from the water-jetting mechanism is directed to the surface of the bath water.

7 Claims, 3 Drawing Sheets

FLOATABLE BUBBLE BATH ASSEMBLY

This is a continuation-in-part of co-pending application Ser. No. 249,862 filed on Sept. 27, 1988, now abandoned.

BACKGROUND OF THE INVENTION

This invention relates to a bubble bath assembly which generates a multiplicity of minute bubbles in the water in a bathtub, and, in particular, relates to a bubble bath assembly which floats on the water in a bathtub.

In the related art, International Application No. PCT/JP 84/00409 filed Aug. 24, 1984 (U.S. Patent Application Ser. No. 855,628, now abandoned, discloses a health bath structure having a water-jetting nozzle which is retained above the water in a bathtub. This health bath structure has a pump-encasing housing which must be fixedly mounted on a wall of a bathroom, and therefore installation work is necessary in order to use this structure. Moreover, since this structure is fixed at a specific position, an auxiliary equipment is required to transfer the nozzle to a desired position.

U.S. Pat. No. 3,842,823 discloses a portable hydromassage unit designed to straddle the side wall of a bathtub. This unit has a clamping bracket which is movable along a bridge portion of the housing, which is adapted to rest on the side wall of the bathtub. By adjusting the position of the clamping bracket, the clamping bracket is capable of clamping the side wall in cooperation with a power unit housing which is adapted to be disposed outside the bathtub, and whereby the hydromassage unit is removably installed on the side wall of the bathtub. However, when the side wall of a bathtub has a thickness exceeding the range of the movement of the clamping bracket, it is not possible to mount the hydromassage unit on the bathtub. In particular to a bathtub of a dugout type, a hydromassage unit of the above-mentioned type can not be applied.

SUMMARY OF THE INVENTION

Accordingly, it is an object of the present invention to provide a bubble bath assembly which is applicable to any type of bathtub.

Another object of the present invention is to provide a bubble bath assembly for which there is no need of installation work, and thus it is easy to handle.

A further object of the present invention is to provide a bubble bath assembly which can easily be transferred to the desired position in a bathtub.

With these and other objects in view, the present invention provides a bubble bath assembly including: a housing having an inlet and an outlet; pump means, encased within the housing, for drawing water into the housing through the inlet and for discharging water under pressure from the outlet; and water-jetting means, communicatively connected to the outlet of the housing, for discharging water in a jet therefrom. This assembly is characterized in that the housing comprises float means for floating the bubble bath assembly on bath water. When the assembly is on the bath water, the float means causes the water-jetting means to be held over the bath water and allows the inlet of the housing to be held under the bath water. The assembly is also characterized in that the water-jetting means has an outlet port which directly confronts the bath water when the assembly floats on the bath water. Because of the outlet port, water to be discharged from the water-jetting means is to be directed to the surface of the bath water.

It is preferred that the center axis of the housing is disposed substantially vertically when the assembly floats on the bath water. The housing may have upper and lower portions such that, when the assembly is on the bath water, the upper portion is held over the bath water, and the lower portion is held under the bath water. The water-jetting means may be a plurality of substantially tubular nozzles, and the outlet port may be a plurality of openings formed on the nozzles so that each of the nozzles has one of the openings. In this case, the nozzles are disposed on the upper portion of the housing so that the openings are arranged at equal angular intervals about the center axis of the housing, and the distances between the center axis and the respective openings are equal. It is preferred that each of the openings has an axis parallel to the center axis of the housing, and the inlet of the housing is disposed on the lower portion of the housing.

The housing may include an inner partition wall dividing the interior space of the housing into an air chamber and a pump chamber. In this case, the pump chamber receives the pump means and is in fluid communication with the inlet and outlet of the housing. The float means may be the air chamber.

The housing may have a plurality of hollow protrusions disposed thereon at equal angular intervals about the center axis of the housing. In this case, the air chamber is defined by the inner faces of the hollow protrusions and the inner partition wall.

DETAILED DESCRIPTION OF THE PREFERRED EMBODIMENT

Figure 1:
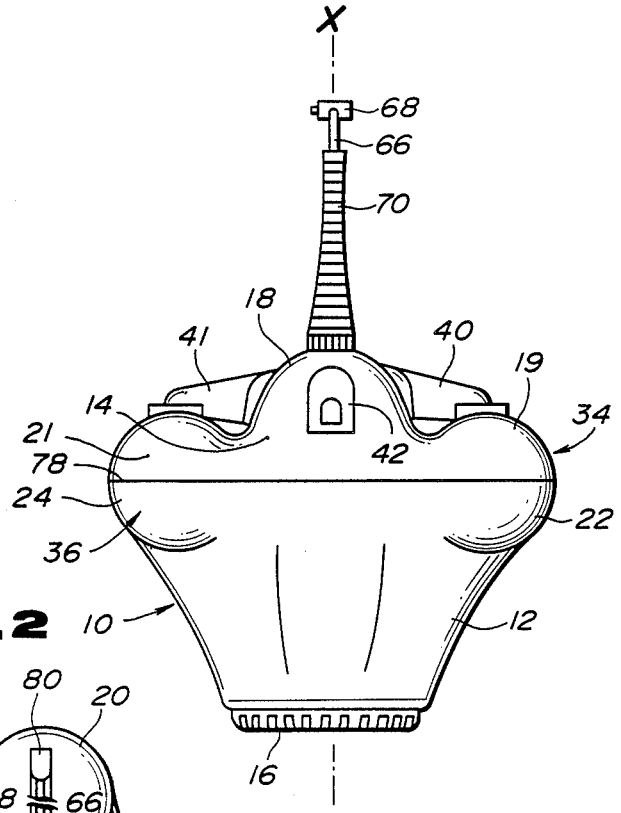
FIG. 1 is a side-elevational view of a bubble bath assembly according to the present invention.

Referring now to the drawings, like reference characters designate corresponding parts throughout several views, and descriptions of the corresponding parts are omitted once given.

FIGS. 1 to 4 show a bubble bath assembly of a free-floating type, embodying the principle of the present invention. Reference numeral 10 designates a housing made of a plastic. This housing 10 is constituted of a hollow lower member 12 of a substantially truncated trigonal pyramidal configuration with larger and smaller open ends, a lid-like upper member 14 of a rounded-angled triangular configuration, hermetically closing the larger open end of the lower member 12, and a filter cap 16 of a flat sieve-like structure covering the smaller open end of the lower member 12.

The upper member 14 has a hollow semispherical central projection 18 and three hollow semispherical peripheral projections 19, 20 and 21. The central projection 18 is centrally disposed on the outer face of the upper member 14 while the peripheral projections 19, 20 and 21 are disposed respectively at the three corners of the upper member 14 to form the rounded angles. That is, the peripheral projections 19, 20 and 21 are disposed on the outer face of the upper member 14 at equal angular intervals around the central projection 18. The upper member 14 also has a tubular inner wall 17 disposed on that portion of the upper member's inner face along the circumference of the central projection 18.

Figure 3:
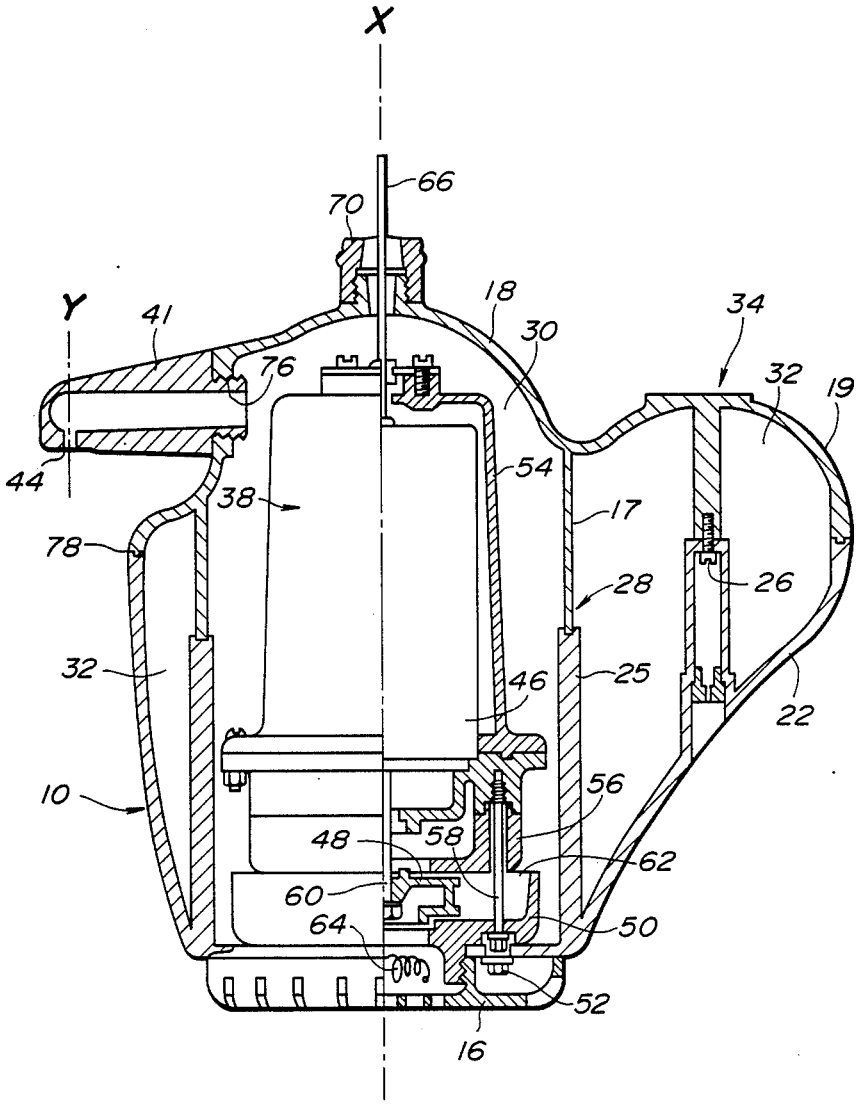
FIG. 3 is a view taken along the line III—III in FIG. 2, in which a part of a pump mechanism is shown in elevation.

The lower member 12 has three hollow hemisphere-like portions 22, 23 and 24 projecting outward respectively from the three corners at the open larger end thereof. A tubular inner wall 25 is disposed within the lower member 12, and is joined at its lower end coaxially to the smaller end of the lower member 12. As best shown in FIG. 3, the upper member 14 is secured to the open larger end of the lower member 12 by screws 26 in such a manner that the peripheral projections 19, 20 and 21 of the upper member 14 are mated respectively with the hemisphere-like portions 22, 23 and 24 of the lower member, and the respective inner walls 17 and 25 are coaxially connected at their free ends with each other. That is, when the upper and lower members 14 and 12 are secured to each other, the inner walls 17 and 25 form a resultant tubular partition wall 28 disposed coaxially within the housing 10, and the hemisphere-like portions 22, 23 and 24 and the semispherical projections 19, 20 and 21 form three identical hollow spherical protrusions 34, 35 and 36 which are disposed on the housing 10 at equal angular intervals about the center axis X of the housing 10.

The partition wall 28 hermetically divides the interior space of the housing 10 into two principal chambers, namely, a pump chamber 30 and an air chamber 32 surrounding the pump chamber 30. The pump chamber 30 is defined by the inner face of the tubular partition wall 28 and the respective inner faces of the filter cap 16 and the central projection 18, while the air chamber 32 is defined by the outer face of the partition wall 28 and the inner peripheral face of the housing 10. The air chamber 32 includes three main sections, i.e., the respective internal spaces of the three spherical protrusions 34, 35 and 36, and three passages, each communicatively interconnecting the corresponding two main sections. A pump mechanism 38 is fixedly received in the pump chamber 30, while air at an atmosphere is filled in the air chamber 32. That is, the air chamber 32, particularly the three spherical protrusions 34, 35 and 36 of the housing 10, serve as float means for floating this bubble bath assembly on water. When this assembly floats on water with its upper member 14 facing upward, the assembly is subjected to a buoyancy such that the waterline comes up to the seam 78 between the upper member 14 and the lower member 12. In other words, the assembly can float on water with its lower member 12 under the water and its upper member 14 over the water. In this embodiment, since the three spherical protrusions 34, 35 and 36 are arranged around the larger end of the lower member 12, the distance between the center of buoyancy of the assembly and the filter cap 16 is longer than that between the center of gravity of the assembly and the filter cap 16. Consequently, when this bubble bath assembly is placed on water with its upper member 14 facing upward, it floats on the water considerably stably. In addition, both the center of buoyancy and the center of gravity of the assembly are disposed on the center axis X.

Figure 2:
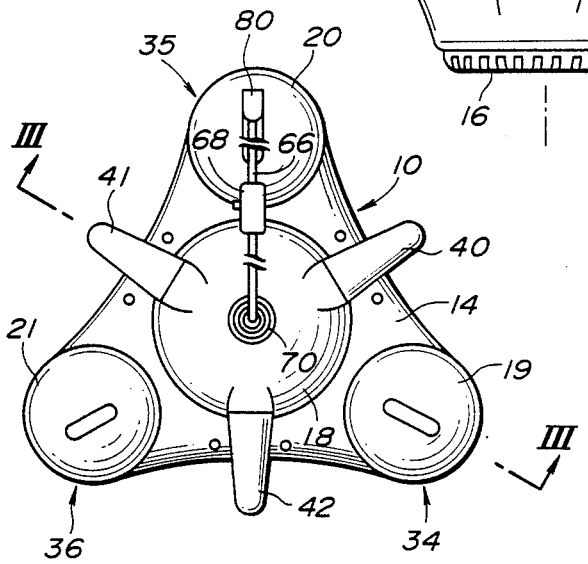
FIG. 2 is a plan view of the bubble bath assembly shown in FIG. 1.

An outlet of the pump chamber 30 in the form of three threaded through holes 76 (only one shown in FIG. 3) are disposed on the central projection 18 of the housing at equal angular intervals about the center axis X. As best shown in FIG. 2, three identical tubular nozzles 40, 41 and 42 are screwed at their threaded proximal ends into the through holes 76, and extend perpendicularly to the center axis X from the central projection. More specifically, the positions of the nozzles 40, 41 and 42 on the housing 10 are such that, when the nozzles are viewed from a plane perpendicular to the axis X, each nozzle is disposed between the corresponding two spherical protrusions. Each of the nozzles is provided at its distal end with an outlet opening 44 open down ward as viewed FIG. 3. That is, the axis of each opening 44 is parallel to the center axis X of the housing. The length of each nozzle is such that, when the bubble bath assembly is viewed from a plane perpendicular to the axis X, the distal end of the nozzle project outward over the outer face of the housing 10. In other words, the distance between the center axis X and the axis Y of each opening 44 is longer than that between the center axis X and the outer face of that portion of the housing 10 excluding the spherical protrusions.

The pump mechanism 38 include a electric motor 46, impeller 48 and other members. To describe the pump mechanism 38 more specifically, a substantially annular guide tube 50 is fitted in the smaller end of the lower member 12 to form an inlet of the pump chamber 30, and is secured by screws 52 to the lower member 12. The motor 46 is hermetically enclosed by a motor container 54, and is secured through a spacer 56 to the guide tube 50 by means of bolts 58 so that the output shaft 60 of the motor 46 is arranged coaxially with the housing 10. The impeller 48 is operatively connected to the output shaft 60 and is disposed within the guide tube 50. Water paths in the form of gaps 62 are formed between the spacer 56 and the guide tube 50 so as to allow water in the guide tube 50 to flow into the pump chamber 30. The filter cap 16 is threadedly engaged with the guide tube 50 to cover the inlet, that is, the smaller end of the lower member 12. A filter medium 64 is interposed between the filter cap 16 and the guide tube 50 to filtrate water to go through the inlet.

Figure 4:
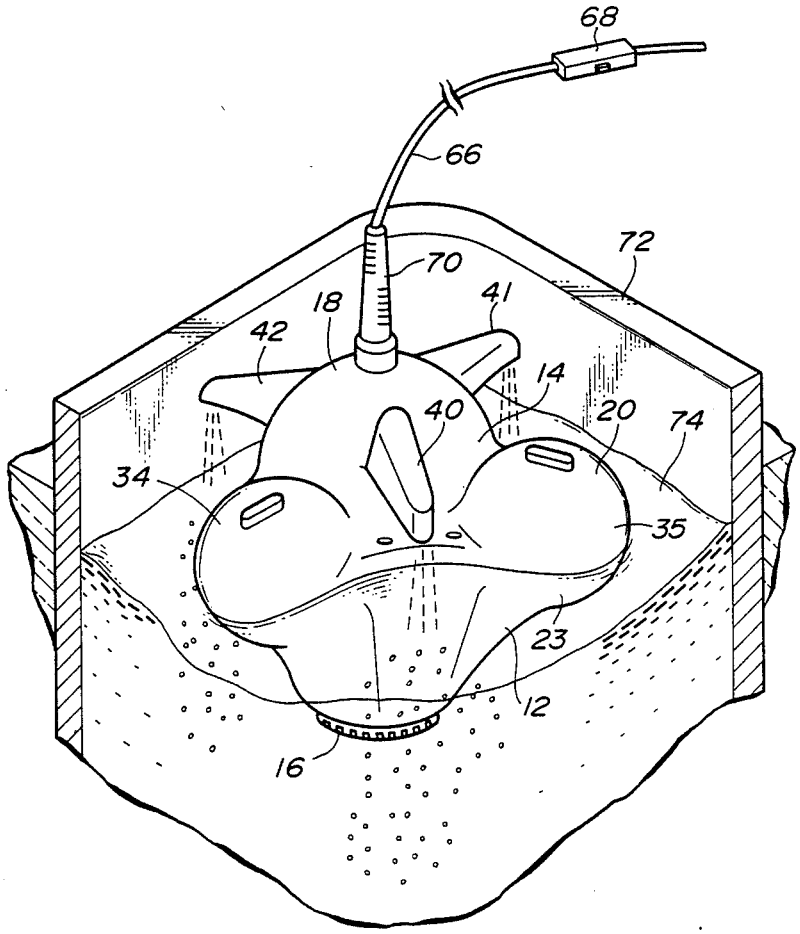
FIG. 4 is a perspective view of the bubble bath assembly in FIG. 1, showing the assembly floating on water in a bathtub.

As best shown in FIG. 4, an electric cord 66 is disposed on the assembly in order to connect the motor 46 of the pump mechanism 38 to an electric power box (not shown) which is to be separately installed from the bubble bath assembly. This electric cord 66 extends from the motor 46 to the central projection 18, and passes out of the housing 10 through the summit of the central projection 18. A waterproof off/on switch 68 for the motor 46 is disposed at an intermediate portion of the cord 66. The electric power box is, for example, a converter for converting a current of AC 100 V into a current of DC 12 V and for supplying the motor 46 with the current of DC 12 V. Otherwise, the power box is a battery charger able to continuously supply a current of DC 12 V for approximately 1.5 hours without the charging of electric power and able to be charged from a electric power source supplying a current of AC 100 V. A waterproof connector 80 (see FIG. 2) is used for electrically connecting the cord 66 to the power box. A plurality of suction cups (not shown) are attached to the cord 66 to fasten the cord 66 to a bathroom wall or a side wall of a bathtub. Fastening the cord 66 to such walls helps the assembly to be steady on the water in a bathtub. It is preferred that these suction cups are connected to the cord 66 for sliding movement along the cord 66. Reference numeral 70 designates a cord protector for protecting the cord 66 from an external force.

The operation of the bubble bath assembly thus constructed will now be described. Upon using the bubble bath assembly, the entire assembly except for the power box is brought into a bathroom in which a bathtub is installed, while the electric power box is left outside the bathroom. Then, as shown in FIG. 4, the assembly is floated on water 74 in the bathtub 72 with its upper member 14 facing upward. That is all preoperation which should be accomplished before the switch 68 is turned on, and thus no more work for installing the assembly is required. When the assembly is on the bath water 74, the axis X is vertically disposed, the lower member 12 is held under the bath water 74, and the upper member 14 is held over the bath water 74. Therefore, the nozzles 40, 41 and 42 are retained above the bath water 74, and the inlet of the pump chamber 30 is held under the bath water.

Subsequently, the switch 68 is turned on to actuate the motor 46. Due to the actuation of the motor 46, the bath water 74 is drawn into the guide tube 50 through the filter cap 16 and filter medium 64, and then is led into the pump chamber 30. The water drawn into the pump chamber 30 is, then, pressurized and is sent to the nozzles 40, 41 and 42. The water is, subsequently, discharged in a jet from the outlet openings 44 of the nozzles 40, 41 and 42, and is directed vertically against the surface of the bath water 74.

When water is sucked into the pump chamber 30 through the filter cap 16 and the like, a reaction force to the suction is exerted on the assembly so as to urge the assembly downward. However, since another reaction force due to the jetted water discharged from the nozzles, counteracts the reaction force due to the suction, the level of the waterline on the housing 10 does not move during the operation. Also, the reaction force due to the jet of water, which is exerted on the assembly, is directed parallel to the axis X of the housing 10 because the outlet openings 44 are disposed at equal angular intervals about the center axis X, and the distances between the center axis X and the respective outlet openings 44 are equal, and further because the axis Y of each outlet 44 is parallel to the center axis X. Therefore, the bubble bath assembly is kept steady on the bath water during its operation.

When the jet of water impinges on the surface of the bath water 74, it introduces oxygen in atmosphere into the bath water 74. This results in the generation of a multiplicity of minute bubbles suspended throughout the water 74. When these innumerable bubbles in the water 74 contact the human body immersed in the bath water 74, they break instantly, and generate ultrasonic waves throughout the bathtub 72. These ultrasonic waves enhance the heat transfer rate between the bath water 74 and the human body, massage the human body and promote the removal of dirt and oils from the skin of the human body, which help in the prevention of skin diseases and muscular pains which can afflict the human body.

In addition, when it is not necessary or not required to keep the aforementioned assembly in the bathtub, the assembly can easily be removed from the bathtub 72. Also, when the impact of the jetted water is required on a specific part of the human body, the whole assembly can easily be moved to locate the nozzles 40, 41 and 42 to the exact position where the nozzles can affect the specific part.

EXAMPLE

A test bubble bath assembly equivalent to the assembly shown in FIGS. 1 to 4 was prepared. This assembly's housing including the cord protector had a height of about 39 cm and a maximum transverse outer size of about 33 cm. The weight of the assembly was about 3.5 kg. A pump motor contained in the housing was such that it was able to cause water to be discharged from three nozzles at the maximum flow rate of 80 lit./min.

The bubble bath assembly described above was floated on water in a bathtub, and the assembly was operated. Then, the position of the waterline on the housing was checked. The result was that the distance between the waterline and the filter cap was 16 cm, and the waterline was substantially coincidental with the seam between upper and lower members. Also, the frequency of ultrasonic waves generated due to the burst of the minute bubbles was measured. The result was that it was about 20,000 to 80,000 Hz.

What is claimed is:

1. In a bubble bath assembly for creating a bubbling effect in water in a bathtub, the bubble bath assembly including: a housing having an inlet and an outlet; pump means, encased within the housing, for drawing water into the housing through the inlet and for discharging water under pressure from the outlet; and water-jetting means, communicatively connected to the outlet of the housing, for discharging water in a jet therefrom, the improvement wherein the housing comprises float means for floating the bubble bath assembly on bath water in such a manner that the water-jetting means is held over the bath water and the inlet of the housing is held under the bath water, and wherein the water-jetting means has an outlet port which directly confronts the bath water when the assembly floats on the bath water, so that water to be discharged from the water-jetting means is directed to the surface of the bath water.

2. A bubble bath assembly according to claim 1, wherein the housing has a center axis and upper and lower portions, the center axis extending between the upper and lower portions, and being disposed substantially vertically when the assembly floats on the bath water, the upper portion being held over the bath water when the assembly floats on the bath water, the lower portion being held under the bath water when the assembly floats on the bath water, wherein the water-jetting means comprises a plurality of substantially tubular nozzles, wherein the outlet port is a plurality of openings formed on the nozzles so that each of the nozzles has one of the openings, each of the openings having an axis parallel to the center axis of the housing, the nozzles being disposed on the upper portion of the housing so that the openings are arranged at equal angular intervals about the center axis of the housing and the distances between the center axis and the respective openings are equal, and wherein the inlet of the housing is disposed on the lower portion of the housing.

3. A bubble bath assembly according to claim 2, wherein the housing includes an inner partition wall dividing the interior space of the housing into an air chamber and a pump chamber, the pump chamber receiving the pump means and being in fluid communication with the inlet and outlet of the housing, and wherein the float means comprises the air chamber.

4. A bubble bath assembly according to claim 3, wherein the housing has a plurality of hollow protrusions disposed thereon at equal angular intervals about the center axis of the housing, and wherein the air chamber is defined by the inner faces of the hollow protrusions and the inner partition wall.

5. A bubble bath assembly according to claim 4, wherein each of the nozzles is interposed between the corresponding two adjoining hollow protrusions when the nozzles are viewed from a plane perpendicular to the center axis of the housing, each of the nozzles extending perpendicularly to the center axis of the housing from the upper portion of the housing so that the distance between the center axis and the opening of the corresponding nozzle is longer than the distance between the center axis and the outer peripheral face of that portion of the housing excluding the hollow protrusions.

6. A bubble bath assembly according to claim 5, wherein the number of nozzles is three, and wherein the number of the hollow protrusions is three.

7. A bubble bath assembly according to claim 1, wherein the pump means includes an electric motor and an electric cord for electrically connecting the motor to an electric power source, the electric cord having a suction cup, attached thereto, for fastening the cord to any stable objects adjacent to the assembly.

* * * * *